United States Patent [19]

Bykowski

[11] Patent Number: 4,813,231

[45] Date of Patent: Mar. 21, 1989

[54] ENGINE EXHAUST AFTER-TREATMENT DEVICE

[75] Inventor: Bruce B. Bykowski, San Antonio, Tex.

[73] Assignee: Southwest Research Institute, San Antonio, Tex.

[21] Appl. No.: 105,767

[22] Filed: Oct. 7, 1987

[51] Int. Cl.[4] ..... F01N 3/02

[52] U.S. Cl. ..... 60/274; 55/466; 55/523; 55/DIG. 30; 60/286; 60/303

[58] Field of Search ..... 60/303, 286, 274; 55/DIG. 30, 523, 466

[56] References Cited

U.S. PATENT DOCUMENTS 4,485,621 12/1984 Wong ..... 60/303

4,535,589 8/1985 Yoshida ..... 60/303

*Primary Examiner*—Douglas Hart

*Attorney, Agent, or Firm*—Sigalos, Levine & Montgomery

[57] ABSTRACT

A diesel particulate trap formed from silicon carbide cermet foam with associated hardware to retain the foam in a particular configuration. Several pieces of the foam, in the shape of "doughnuts", are stacked on top of each other. The stack of foam doughnuts is assembled in a container designed to allow diesel exhaust to flow radially inward through the doughnuts and exit through the center. Ceramic felt gaskets are interposed between the doughnuts and between each of the end doughnuts and steel end plates. These gaskets serve as buffers and allow for different thermal expansion properties of the steel and silicon carbide cermet foam. The silicon carbide is conducting and has resistance and when current is passed through the foam doughnuts, they become hot enough to burn the collected particulate.

6 Claims, 2 Drawing Sheets

ENGINE EXHAUST AFTER-TREATMENT DEVICE

BACKGROUND OF THE INVENTION

The present invention relates to an engine exhaust after-treatment device for trapping particulate matter and, in particular, relates to a diesel particulate trap constructed from a silicon carbide cermet foam for trapping the particulate matter. Combustion of the collected particulate cleans and regenerates the trap.

It is necessary in engine exhausts, and in particular diesel engine exhausts, to collect and trap particulate matter which is in the exhaust. The most commonly used filters for these traps are of the ceramic type (cordierite) and these filters are very effective in removing and trapping the particulate matter. However, the volume of the particulates trapped and removed from the exhaust is of such an amount that the filters have to be removed and replaced frequently.

In order to avoid removing or replacing the filters, prior art techniques burn the collected particulate in situ in the filter by a variety of methods. Any technique to increase the exhaust temperature to 600° C. will ignite the collected particulate. Techniques which are normally used to increase exhaust temperature include high engine load, intake air throttling, the use of diesel fuel or a propane burner in the exhaust, or the use of an electric resistance heater in the exhaust to raise the exhaust temperature. The ceramic filters that are used in such cases have several disadvantages however. They have temperature limitations which must not be exceeded. Their thermal conductivity is such that localized hot spots may occur and thus cracking occurs due to thermal gradients or vibrational shock.

The present invention overcomes the disadvantages of the prior art by forming a diesel particulate trap from silicon carbide cermet foam with associated hardware to retain the foam in a particular configuration. Several pieces of the foam, in the shape of "doughnuts", are stacked on top of each other. The stack of foam doughnuts is assembled in a container designed to allow diesel exhaust to flow radially inward through the doughnuts and exit through the center. Ceramic felt gaskets are interposed between the doughnuts and between each of the end doughnuts and steel end plates. These gaskets serve as buffers and allow for different thermal expansion properties of the steel and silicon carbide cermet foam.

The foam doughnuts and gaskets are held together and compressed slightly by two steel end plates. Each plate is slightly larger than the diameter of the doughnuts. One plate is solid and the other has an orifice in the center thereof. The doughnut holes are aligned with the orifice in the end plate. The entire assembly is placed in a steel sleeve having a cone at each end; an exhaust entrance cone and an exhaust exit cone. The diesel exhaust enters the exhaust entry cone and impacts the closed end plate of the doughnut assembly. It then flow around the end plate to enter the space between the outside doughnut surface and the steel sleeve. The exhaust then passes radially inwardly through the silicon carbide doughnuts and exits through the center holes and out the exhaust cone. During passage through the foam doughnuts, the diesel particulate is collected and retained.

The use of the silicon carbide foam overcomes the temperature limitations of the current system. The silicon carbide has a higher melting point than the ceramic most commonly used (cordierite) and its higher thermal conductivity will tend to prevent localized hot spots. The individual doughnuts will be less prone to cracking caused by thermal gradients or vibrational shock because of the buffering action of the ceramic felt spacers. Collecting the particulate by impaction rather than filtration allows for a self-limiting collection mass and therefore minimizes plugging of the filter. In addition, the free silicon remaining in the silicon carbide adds flexibility to the foam to allow for slight movement within the doughnut without cracking.

It is desired that the collected particulate be burned in situ by any of a variety of methods. As stated earlier, any technique to increase exhaust temperature to 600° C. will ignite the collected particulate. With the present invention, the electrical properties of the carbide enable a novel approach to burn the collected particulate. Rather than using an electric heating element to heat the exhaust temperature to 600° C. for combustion, the current is passed directly through each silicon carbide doughnut. The silicon carbide is conductive and has resistance and will become hot enough to burn the collected particulate.

The invention may also be used as a support for catalysts for both diesel particulate traps and gasoline exhausts. Catalysts applied to current diesel particulate trap media lower the temperature requirement for particulate combustion but do not reduce the temperature limitations of the support material. Thus the invention is also usable as a high temperature catalyst support for gasoline engines and natural gas engines.

Thus it is an object of the present invention to provide a novel exhaust particulate trap.

It is also an object of the present invention to provide a diesel exhaust particulate trap utilizing silicon carbide cermet foam as the trap.

It is still another object of the present invention to utilize a trap having an electrically conductive material integrally formed with the filter in the trap for generating heat when an electrical current is passed therethrough to raise the temperature of the filter and burn off particulate matter trapped thereon.

It is yet another object of the present invention to provide a foamed silicon carbide filter element in the shape of a plurality of doughnut shaped segments formed of the foamed silicon carbide with a first conductive mesh unit making electrical contact with the outside of the doughnut and a second conductive mesh unit making electrical contact with the inside of the doughnut so that electrical power can be applied to the two mesh units to provide an electrical current path through the electrically conductive carbide foam.

It is still another object of the present invention to provide a diesel particulate trap having at least one foamed silicon carbide element with a porous construction for trapping the particulate matter and being electrically conductive for generating heat when a current is passed therethrough to thereby burn the particulate matter trapped in the porous material and clean and regenerate the particulate trap.

SUMMARY OF THE INVENTION

Thus the present invention relates to an engine exhaust after-treatment device for trapping particulate matter comprising a container having an exhaust input and an exhaust output and at least one foamed silicon-carbide filter element positioned in the container such that any exhaust from the engine at the exhaust input to the container must pass through the foamed silicon-carbide filter prior to passing through the exhaust output of the filter to trap the particulate matter.

The invention also relates to a foamed silicon-carbide filter which is electrically conductive so as to generate heat when electrical current is passed therethrough.

The invention also relates to an engine exhaust after-treatment device for trapping particulate matter comprising a container having an exhaust input and an exhaust output, a filter positioned in the container such that any exhaust input must pass through the filter and an electrically conductive material integrally formed with the filter for generating heat when an electrical current is passed therethrough to raise the temperature of the filter and burn off the particulate matter trapped thereon.

BRIEF DESCRIPTION OF THE DRAWINGS

These and other objects of the present invention will be disclosed in conjunction with the accompanying drawings in which like numerals indicate like components and in which.

DETAILED DESCRIPTION OF THE DRAWING

Figure 1:
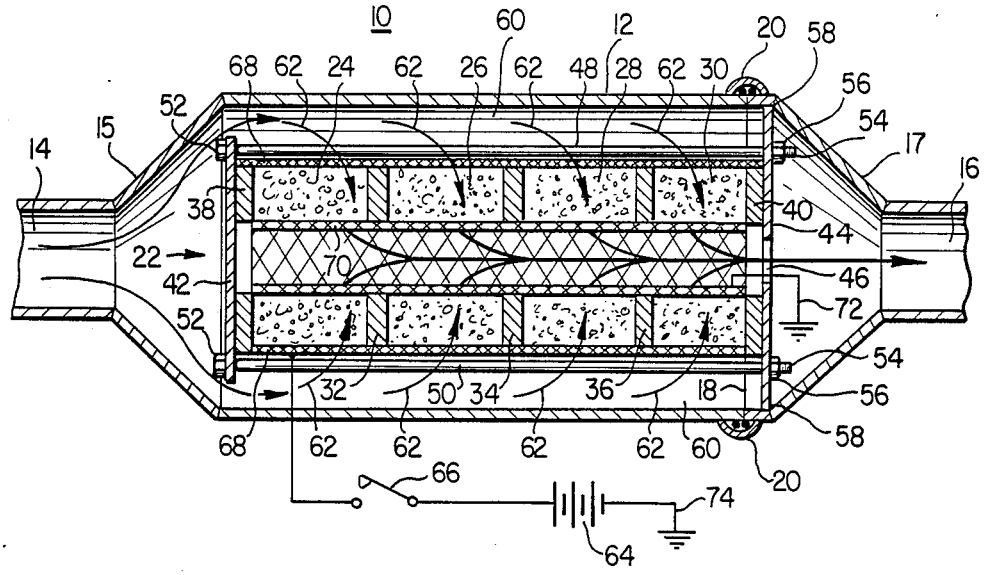
FIG. 1 is a cross-sectional view of one of the diesel particulate traps utilizing the present invention.

The exhaust particulate trap for an engine is generally designated by the numeral 10 in FIG. 1. It comprises an outer casing or sleeve 12 having an exhaust inlet 14 in conical end 15 and an exhaust outlet 16 in conical end 17. Conical end 17 may form an individual section joined with sleeve 12 at 18 by any well-known means such as an adjustable band 20. The trap 22 which is located within sleeve or casing 12 comprises a plurality of silicon-carbide cermet foam "doughnuts" 24, 26, 28 and 30 which are separated by ceramic felt gaskets 32, 34 and 36. These ceramic felt gaskets are used to improve sealing between the doughnuts. The other ceramic felt gaskets 38 and 40 provide sealing between the end doughnuts 24 and 30 and the plates 42 and 44. In addition, the felt gaskets 32, 34, 36, 38 and 40 serve as buffers and allow for the different thermal expansion properties of the steel and carbide cermet foam traps 24, 26, 28 and 30. While four foam traps 24, 26, 28 and 30 are shown, more or less could be used as desired for a particular exhaust system. The number shown is simply for ease of illustration.

The silicon-carbide foam is formed of siliconized alpha-silicon-carbide foam and is of a type known in the art as HEXOLOY and is commercially available. In one particular example, the foam had 60 pores per inch and was in the form of a cylindrical doughnut having a diameter of $5\frac{1}{4}$ inches, a center hole having a diameter of $1\frac{3}{4}$ inches and a thickness of $2\frac{1}{8}$ inches. An improvement in particulate collection efficiency is possible using a foam with 100 pores per inch size rather than 60 ppi.

The ceramic felt gaskets may be of a commercially available material such as a mica based material known as INTERAM or fiberglass or quartz fibers. In each case, each of these felt gaskets are high temperature resistant, resilient and nonconductive electrically. The gaskets, as stated earlier, improve the sealing between the foam traps and force the exhaust to pass through the traps. Further, they serve as buffers which allow for different thermal expansion properties of the steel in relation to the foam trap and reduce cracking of the foam. The foam traps 24, 26, 28 and 30 and the felt gaskets 32, 34, 36, 38 and 40 are held together and compressed slightly by two steel end plates 42 and 44. The end plate 42 is solid while end plate 44 has an orifice 46 therein. A plurality of threaded rods such as 48 and 50 are used to connect the two end plates 42 and 44 and sandwich the foam traps 24, 26, 28 and 30 and the felt gaskets 32, 34, 36, 38 and 40 between them. These rods 48 and 50, which may be more in number than two, are positioned on the outside of the foam traps. A single threaded rod located down the center of the trap may also be used. Preferably three of them 120° apart are used. One end 52 of the threaded rods is attached to the solid end plate 42 and the other end 54 protrudes through an orifice in the end plate 44. A ceramic felt washer (not shown), metal washer (not shown) and nut 56 are used to compress the entire doughnut assembly between the end tes 42 and 44 by tightening the nuts 56. The end plate 44 is attached to the exhaust cone 17 at 58 as, for instance, by welding. Instead of using nuts 56, threaded orifices in end plate 44 may be used. The solid end plate 42 may have one or more tabs (not shown) attached to it around its circumference and extending radially from the plate to contact the inside wall of sleeve 12 for support.

The engine exhaust enters the trap through exhaust input 14 and impacts the closed end of plate 42 thus forcing the exhaust to enter the space 60 between the outside surface of the traps 24, 26, 28 and 30 and the outer sleeve 12. The exhaust then passes radially inwardly through the silicon carbide-doughnut traps 24, 26, 28 and 30 as indicated by the arrows 62. The exhaust then exits through the center holes of the doughnut shaped traps and out through orifice 46 in end plate 44 and finally out the exhaust output 16.

Thus the use of this high temperature-resistant, high-thermal-conductivity material in the form of foam doughnuts 24, 26, 28 and 30 overcomes the temperature limitations of other ceramics and other geometric configurations set forth in the prior art and provides an improved particulate trap. The silicon carbide has a higher melting point than the ceramic most commonly used (cordierite) and its high thermal conductivity will tend to prevent local hot spots. Individual traps or doughnuts 24, 26, 28 and 30 are less prone to cracking caused by thermal gradients or vibrational shock because of the buffering action of the ceramic felt separators 32, 34, 36, 38 and 40. In addition, the free silicon remaining in the silicon-carbide adds flexibility to the foam to allow for slight movement within the doughnut without cracking.

Finally, collecting particulate matter by impaction rather than filtration allows for a self-limiting collection mass and therefore minimized plugging of the trap.

It does become necessary from time to time to clean or regenerate the filter. Techniques normally used include high engine load, intake air throttling, or the use of a diesel fuel or propane burner in the exhaust. Use of an electric resistance heater in the exhaust can also increase the exhaust temperature.

In the present system, the electrical properties of the carbide provide a novel approach used to burn off the collected particulate. Rather than using an electric heating element to heat the exhaust temperature to 600° C. for combustion, the current is passed through each silicon carbide doughnut 24, 26, 28 and 30. As stated earlier, the carbide in the foam is electrically conductive and since the foam is a "reticulated" foam, electrical contact can be made with the surface. The silicon-carbide, as the current flows through it, will become hot enough to burn the collected particulate. In FIG. 1, a battery 64 is coupled through switch 66 to a inductive mesh 68 which is in electrical contact with the surface of each of the foam traps 24, 26, 28 and 30. In addition, on the inside of each of the doughnut shaped foam traps is a second conductive mesh 70 which electrically contacts the inner surfaces of each of the foam traps 24, 26, 28 and 30. This second conductive mesh 70 is coupled to a ground 72. The negative terminal of battery 64 is also coupled to a ground 74 thus completing a circuit through the electrically conductive foamed silicon-carbide doughnut shaped traps 24, 26, 28 and 30. When switch 66 is closed, the current flows through each of the foam traps in parallel and the temperature of each of the foam traps is raised sufficiently to burn off the particulate matter collected therein. During regeneration the engine exhaust should bypass the trap and a small amount of air injected to continue combustion.

Figure 2:
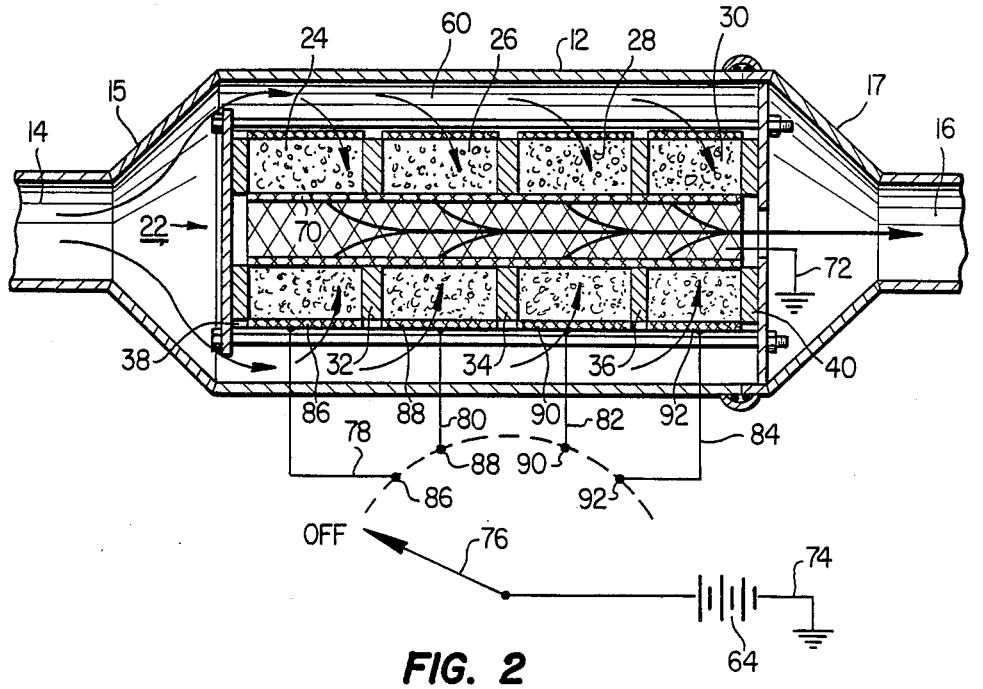
FIG. 2 is a cross-sectional view of a preferred embodiment of the present invention in which a current can be passed through each of the doughnut shaped silicon-carbide cermet foam particulate traps to burn off the particulate matter and regenerate each of the particulate traps.

The filter illustrated in FIG. 2 is identical to that in FIG. 1 except for the manner in which the battery 64 is coupled to the silicon foam traps 24, 26, 28 and 30. It will be noted in FIG. 2 that each of the foam carbide traps 24, 26, 28 and 30 has a separate outer conductive mesh 86, 88, 90 and 92 in contact with its outer surface. Each of these conductive mesh elements is coupled through leads 78, 80, 82 and 84, respectively, to a switch 76. The switch 76 may be of any well-known type having multiple contacts with an "off" position and current contacts 86, 88, 90 and 92 which are coupled respectively to the input lines 78, 80, 82 and 84 to provide current to the individual carbide foamed doughnuts.

Thus when switch 76 is electrically coupled to contact 86, current from the battery flows through lines 78, conductive mesh 86, the foamed carbide particulate trap 24, the internal mesh screen 70 and ground 72 whereby it returns through ground 74 to the negative terminal of battery 64. This enables the entire power output from battery or power source 64 to be applied to each foamed carbide particulate trap individually. The power source 64, instead of being a battery, may be the electrical system of the engine which, while the engine is running, is available to use to regenerate or clean the particulate trap 22 by burning away the particulate as indicated earlier. The other foamed carbide elements 26, 28 and 30 are regenerated in a similar manner by moving the switch 76 successively to contact the points 88, 90 and 92. This regeneration process may take place during operation of the filter. This means that the engine does not have to be shut down while the filter is regenerated which is a significant advantage over the prior art.

Figure 3:
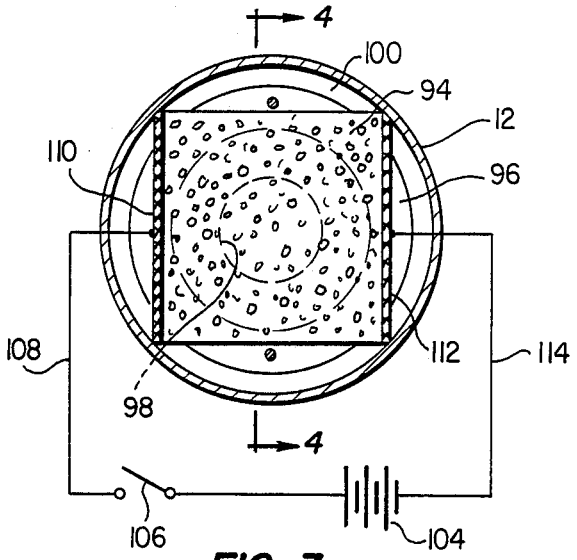
FIG. 3 is a longitudinal cross-sectional view of still another embodiment of the present invention which is a particulate trap utilizing a solid block of the silicon-cabide cermet foam for the entire filter.
Figure 4:
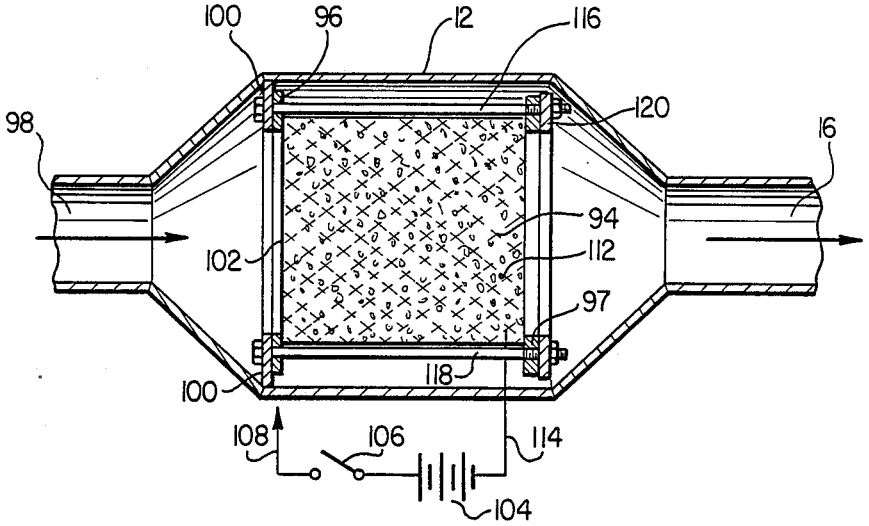
FIG. 4 is a cross-sectional view taken along lines 4—4 of FIG. 3.

FIGS. 3 and 4 are cross-sectional views of another embodiment of the present invention in which the particulate trap is a single block of filter material through which axial flow of the exhaust enables the particulate matter to be trapped by the foamed silicon carbide material. Thus, FIG. 3, which is a cross-sectional view looking axially across a section of the filter, again includes an outer sleeve 12 in which is placed a solid block 94 of the foamed silicon-carbide particulate trap. A ceramic felt gasket 96 separates the particulate trap 94 from the steel plate 100 which is rigidly attached to the outer sleeve 12 in any well known manner such as by welding.

Exhaust inlet orifice 98 allows the incoming exhaust to impact against face 102 (FIG. 4) of the silicon carbide foam block 94. Steel ring 100 prevents the input exhaust from by-passing the foam block 94 and forces it to impact against face 102. Again, bolts 116 and 118 are attached to steel ring 100 and steel ring 120 to hold the foam block 94 and felt spacers 96 and 97 in a sandwich arrangement. Mesh screens 110 and 112 (FIG. 3) are applied to the side faces of the block in electrical contact with the foam material. Power source 104 is coupled through switch 106 and conductor 108 to conductive mesh 110 (not shown in FIG. 4). Conductive mesh 112 is coupled through conductor 114 back to the other side of power source 104. Thus when switch 106 is closed, current travels through the completed circuit including the carbide foam block 94 thus burning off the particulate and regenerating the filter.

Thus there has been disclosed an engine exhaust after-treatment device for trapping particulate matter which utilizes a foamed silicon carbide filter element positioned in an enclosure such that any exhaust from the engine must pass through the foamed silicon-carbide filter prior to passing through the exhaust output thereby trapping particulate matter.

Further, the novel invention can be used for a catalyst support for both diesel particulate traps and gasoline exhaust catalysts. Catalysts applied to current diesel particulate trap media lower the ignition point required for particulate combustion but do not reduce the temperature limitations of the support material. A need also exists for a high temperature catalyst support for gasoline engines and natural gas engines. The present invention, as stated earlier utilizes the silicon carbide foam which has a higher melting point than a ceramic filter most commonly used. Further, its higher thermal conductivity tends to prevent localized hot spots. The individual doughnut shaped foam doughnuts are less prone to cracking caused by thermal gradients or vibrational shock because of the buffering action of the ceramic felt.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

I claim:

1. An engine exhaust after-treatment device for trapping particulate matter comprising:

a. a container having an exhaust input and an exhaust output;

b. at least one foam silicon-carbide filter element for trapping particular matter positioned in said container such that any exhaust from said engine at said container exhaust input must pass through said foam silicon-carbide filter prior to venting through said exhaust output, said foam silicon-carbide filter being electrically conductive so as to generate heat when electrical current is passed therethrough; said filter element including:

(1) a plurality of doughnut shaped segments formed of said foam silicon-carbide and each having an exhaust input side and an exhaust output side, and (2) a plurality of non-conductive felt gaskets alternately stacked with said doughnut shaped filter segments to electrically insulate said segments from each other and said container; and c. conductive elements in electrical contact with said filter element for enabling said filter element to receive power and generate heat to burn off particulate matter trapped therein.

2. A device as in claim 1 wherein said conductive elements coupled to said filter elements comprises:

a. a plurality of conductive mesh units equal in number to the number of said plurality of doughnut shaped segments, each of said conductive mesh units being in electrical contact with one of said input and output exhaust sides of a corresponding one of said doughnut shaped filter segment, and b. a single conductive mesh unit in electrical contact with the other side of all of said doughnut shaped filter segments,

3. A device as in claim 2 further comprising:

a. a power source having first and second voltage terminals, b. an electrical switch having a single input and multiple outputs, c. means for electrically coupling each switch output to a corresponding one of said plurality of mesh units, d. means for electrically coupling said single switch input to said first voltage terminal of said power source, and e. means for coupling said second voltage terminal of said power source to said single conductive mesh unit thereby enabling an electrical circuit to be completed with each of said doughnut shaped segments through said switch.

4. A method of constructing an engine exhaust after-treatment device for trapping particulate matter comprising:

a. forming a container having an exhaust input and an exhaust output, b. positioning at least one foam silicon-carbide filter element in said container such that any exhaust from said engine at said exhaust input to said container must pass through said foam silicon-carbide filter prior to passing through said exhaust output of said container to trap said particulate matter;

c. electrically contacting said filter element with conductive elements for enabling said filter element to have a current passed therethrough to generate heat and burn off particulate matter trapped therein;

d. forming a plurality of doughnut shaped segments of said foam silicon-carbide, each of said segments having an exhaust input side and an exhaust output side, and e. alternately stacking a plurality of non-conductive felt gaskets with said doughnut shaped filter segments to electrically insulate said segments from each other and said container.

5. A method as in claim 4 wherein said step of electrically contacting said filter element with said conductive elements further comprises the steps of:

a. forming a plurality of conductive mesh units equal in number to the number of said plurality of doughnut shaped segments, b. placing each of said conductive mesh units in electrical contact with only one of said input and output exhaust sides of a corresponding one of said filter segments, and c. placing a single conductive mesh unit in electrical contact with the other side of all of said doughnut shaped filter segments.

6. A device as in claim 5 further comprising the steps of:

a. providing electrical power from first and second voltage terminals, b. forming an electrical switch having a single input and multiple outputs, c. electrically coupling each switch output to a corresponding one of said plurality of mesh units, d. electrically coupling said single switch input to said first voltage terminal of said power source, and e. coupling said second voltage terminal of said power source to said single conductive mesh unit thereby enabling an electrical circuit to be completed selectively with each of said doughnut shaped segments through said switch thereby regenerating each of said filter elements.

* * * * *